US007498526B2

(12) United States Patent
Lohr et al.

(10) Patent No.: US 7,498,526 B2
(45) Date of Patent: Mar. 3, 2009

(54) CORDLESS SCREWDRIVER

(75) Inventors: Guenter Lohr, Leinfelden-Echterdingen (DE); Heiko Roehm, Stuttgart (DE); Wolfgang Hirschburger, Thurston (GB); Sven Kageler, Leinfelden-Echterdingen (DE); Mohsein Wan, Penang (MY); Abdul Aziz Zulfikar, Penang (MY); Sim Teik Yeoh, Butterworth (MY); Joseph Siang Choon Lim, Penang (MY)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/573,389

(22) PCT Filed: Jun. 29, 2005

(86) PCT No.: PCT/EP2005/053073

§ 371 (c)(1),
(2), (4) Date: Jun. 22, 2007

(87) PCT Pub. No.: WO2006/015909

PCT Pub. Date: Feb. 16, 2006

(65) Prior Publication Data

US 2007/0256914 A1 Nov. 8, 2007

(30) Foreign Application Priority Data

Aug. 9, 2004 (DE) ..... 10 2004 038 787
Oct. 26, 2004 (DE) ..... 10 2004 051 913

(51) Int. Cl.
*H01H 9/26* (2006.01)

(52) U.S. Cl. ..... 200/5 A; 200/522

(58) Field of Classification Search ..... 200/520, 200/274, 329–332.2, 43.11, 43.17, 43.18, 200/334, 61.85, 1 V
See application file for complete search history.

(56) References Cited

U.S. PATENT DOCUMENTS

| | | | | | |
|---|---|---|---|---|---|
| 3,676,627 | A | * | 7/1972 | Happe | 200/522 |
| 3,703,646 | A | * | 11/1972 | Jacyno | 310/47 |
| 4,054,766 | A | * | 10/1977 | Kramer | 200/522 |
| 4,064,447 | A | * | 12/1977 | Edgell et al. | 320/111 |
| 4,078,869 | A | | 3/1978 | Honeycutt | |
| 4,204,580 | A | * | 5/1980 | Nalley | 173/48 |
| 4,328,405 | A | * | 5/1982 | Cuneo | 200/522 |
| 4,700,031 | A | * | 10/1987 | Claghorn et al. | 200/522 |
| 4,847,451 | A | * | 7/1989 | Nagata | 200/1 V |
| 4,934,494 | A | * | 6/1990 | Fushiya et al. | 477/8 |

(Continued)

FOREIGN PATENT DOCUMENTS

CN 02282987.3 10/2003

(Continued)

*Primary Examiner*—Michael A Friedhofer
*Assistant Examiner*—Lisa N Klaus
(74) *Attorney, Agent, or Firm*—Michael J. Striker

(57) ABSTRACT

A cordless screwdriver, having a housing (12, 18) with a pistol grip (14) with an ON/OFF button (26) and a rechargeable battery (40) inserted into it, in particular fixedly and with charging contact tongues (37) associated with the battery (40), is made safer and more convenient by providing that by means of the toggle switch (26), extending in elongated fashion over the inside of the pistol grip (14) and in particular pivotably supported, a plurality of power circuits of the cordless screwdriver (10) are interruptable and closable over the actuation stroke of the toggle switch successively independently of one another.

10 Claims, 8 Drawing Sheets

U.S. PATENT DOCUMENTS

| | | | | |
|---|---|---|---|---|
| 4,947,475 | A | 8/1990 | Bright | |
| 5,598,082 | A * | 1/1997 | Gilpin et al. | 200/293.1 |
| 5,681,214 | A | 10/1997 | Kleider et al. | |
| 6,206,538 | B1 | 3/2001 | Lemoine | |
| 7,053,325 | B2 * | 5/2006 | Yuasa et al. | 200/522 |
| 7,134,364 | B2 * | 11/2006 | Kageler et al. | 81/52 |
| 2003/0094356 | A1 * | 5/2003 | Waldron | 200/332.2 |
| 2004/0013486 | A1 | 1/2004 | Cooper | |
| 2004/0017177 | A1 | 1/2004 | Santana, Jr. | |
| 2004/0069512 | A1 | 4/2004 | Ng | |
| 2007/0160353 | A1 * | 7/2007 | DeCicco et al. | 388/811 |

FOREIGN PATENT DOCUMENTS

| | | | |
|---|---|---|---|
| DE | 4204580 | A1 * | 8/1993 |
| DE | 195 46 328 | | 6/1997 |
| EP | 0 663 677 | | 7/1995 |
| EP | 1 066 930 | | 1/2001 |
| EP | 1 382 420 | | 1/2004 |

* cited by examiner

| Input variable | | | Output Variable | | | |
|---|---|---|---|---|---|---|
| ON/Off Switch | Counterclockwise/ clockwise switch Position | Charged | Light | | Directional arrows | Motor |
| 0 | / | Not full | Off | Green* | | Off |
| 0 | / | Full | Off | | | Off |
| 1/2 | Clockwise/ couterclockwise | <1/3 | On | | | Off |
| 1/2 | Clockwise/ couterclockwise | >1/3 | On | | | Off |
| 1 | Clockwise/ couterclockwise | <1/3 | On | | Green | On |
| 1 | Clockwise/ couterclockwise | >1/3 | On | | Green | On |

CORDLESS SCREWDRIVER

BACKGROUND OF THE INVENTION

The present invention is based on a cordless screwdriver.

Cordless screwdrivers are already available in the power class between 2.4 V and 3.6 V, as known for instance from European Patent Disclosure 1 066 930. They usually have a plurality of NiCd cells as energy storing means; an ON/OFF button with a short toggle switch and without continuously variable speed governing, and a switch for switchover from counterclockwise to clockwise operation; a gear, in particular a planetary gear, that steps down the motor rpm; and a motor with a standard diameter of 27.5 mm. There are both rodlike and pistol-shaped versions as well as versions with an adjustable-angle handle. For charging, these devices are connected to the charger either via a plug—in a way similar to a cell phone or electric shaver—or via a mount with contacts, into which contacts the rechargeable battery can be placed for charging. The mounts can be secured to a wall, for instance, to make handling while charging easier.

For charging, the charging mode for the charger and for the electrical connection must be brought about, but this does not automatically happen after every use. As a result, the device is often not ready for use precisely when it is needed, and the well-known memory effect is a further disadvantage NiCd cells discharge after a certain length of time without outputting power, and even unused cordless screwdrivers become partly discharged after a short time. If they are charged when they are partly discharged, then because of the memory effect, after the charging operation, only the difference of the newly charged amount—and hence reduced power—is available.

A further disadvantage of the known cordless screwdrivers is their voluminous size because of large structural components, such as the gear, switch system, and the rechargeable battery in the form of NiCd cells, whose ⅔ sub-C size when located in the pistol grip is an impairment to ergonomics and utility, since narrow, angled places where screwing is to be done cannot be reached.

In known cordless screwdrivers with electrical secondary functions, such as a built-in work light, these functions have until now been switched on and off either separately with their own switch or actuating element or synchronously with the switch for the primary function, that is, the motor switch. If the secondary function can be switched separately, then there is the advantage that the light can be switched on as needed, for instance, and does not consume current constantly during operation of the power tool. A disadvantage is that for that purpose, a separate actuating element must first be operated. If by mistake this element is not switched off, the battery discharges unintentionally. This risk does not exist when the secondary function is switched synchronously with the primary function. In that case, however, the secondary function cannot be activated independently of the primary function, as is advantageous for instance with a work light of a screwdriver.

SUMMARY OF THE INVENTION

The invention has the advantage that a plurality of power circuits can be switched on and off independently of one another in the interior of the cordless screwdriver using a single toggle switch (ON/OFF button), and that all the current consumers are in fact off when the toggle switch is in the OFF position.

Because when the toggle switch is depressed and released at least three switching states can be switched, it is possible in the first state—as with a main switch—for all the power circuits to be interrupted and hence for unintentional discharging of the rechargeable battery to be precluded.

Because in the second switching state, at a certain stroke of the toggle switch, the power circuit for the work light is closed and in the third switching state, in a further additional stroke of the toggle switch, the power supply to the motor can be switched on, the work light can be activated either alone or jointly with the motor rotation, depending on the stroke position of the button.

Because a relatively large, hard spiral spring seeks to keep the toggle switch prestressed in its OFF position, its rapid return from the ON to the OFF position is assured, and each of the three switching states is adjustable in a cleanly defined way.

The long toggle switch, extending over virtually the length of the inside of the pistol grip, has an actuation pivoting stroke with which at least two switching positions are associated. As a result—regardless of the actuation position—only slight user operation forces are required, and the device can be switched on in a controlled way conveniently in nearly any position of the user's hand.

Because the motor shaft end associated with the gear has a flattened face, and the corresponding engagement opening of the gear input shaft has the corresponding negative shape, a simple, easily assembled, compact coupling between the motor and the gear is created, which allows even coarse tolerances and functions reliably.

Because the motor housing comprises half shells split in the middle, which in pincerlike fashion grasp the cylindrical gearbox from both sides with radially inward-protruding supporting tongues and firmly hold it centered in the installed position, the gearbox can be connected precisely and securely to the motor housing without such separate fastening or guide elements as screws, centering pins, or overlooking elements.

A further reduction in weight and volume of the cordless screwdriver is attained by dispensing with a chuck, and by means of a hexagonal socket of the power takeoff shaft—fitting corresponding screwdriver or drill bits with hexagonal shafts—these tools can be changed quickly and simply.

Since the lithium-ion battery has almost no self-discharge, the cordless screwdriver is fully ready for use even after long intervals of nonuse, and in intervals of nonuse the cordless screwdriver can rest for an arbitrarily long time on a charging shell in the charging mode. The charging shell can be placed, standing securely, on a flat shelf and need not be secured or firmly held when the cordless screwdriver is removed. As a result, it is always quickly ready for removal with only one hand; no plug has to be unplugged, and no mount has to be removed. Moreover, it is assured automatically at all times that the cordless screwdriver is charged.

The compact lithium-ion battery is seated without play, positionally secured, clamped in the interior of the half shell-like pistol grip regions; two welded-on contact lugs are soldered with electric lead lines to the circuit board on the end regions of the battery. The battery is integrated into the strength structure of the pistol grip and increases its dimensional stability while using little material for the half shells of the housing.

The circuit board intended for control is the chassis of one main switch and one additional switch of charging contact tongues, a sliding switch for switching the direction of rotation and three light-emitting diodes for the two displays showing the direction of rotation, and a charge monitor lamp as well as control means for the charging and discharging current of the lithium-ion battery. The circuit board is also located longitudinally in the interior of the pistol grip in the form of an additional transverse rib integrated into the strength structure of the housing or of the pistol grip and increases its bending strength.

Instead of a boxlike ON/OFF button that is usual in this class and additionally has one position each for clockwise and counterclockwise operation, the concept of a separate preselection of clockwise/counterclockwise operation has been adopted. While in previous drill screwdrivers a separate structural group is mounted for this purpose on the boxlike main switch—in this case a simple and inexpensive sliding switch soldered to the circuit board, in the form of mass-produced electrical goods—is triggerable here via the usual slide by hand, thus creating a simply constructed reversal of the direction of rotation.

The toggle switch and the switch for changing the direction of rotation are designed such that on the one hand when the toggle switch is pressed, the switch for changing the direction of rotation is blocked and cannot be moved, and on the other, the toggle switch is blocked and cannot be pressed into the ON position when the switch for changing the direction of rotation is in its middle position, which is the recommended carrying position.

The charging contact tongues soldered to the circuit board protrude through openings in the lower end of the pistol grip, and in the charging position are contacted by counterpart contacts of the charging shell; no additional cords or coupling plugs have to be actuated.

Depending on the direction of rotation of the motor, a green or red LED, soldered to the circuit board, lights up. These LEDs are visible through arrow-shaped openings in the housing that are covered by means of a transparent plastic part serving as a window. A charge status display, visible through a rectangular opening located between the arrow-shaped openings, by blinking slower or faster, indicates whether the battery is more or less fully charged.

The gearbox is at the same time the outermost wheel of the planetary gear. This economizes on one additional component and makes the device slender and compact, with only slight mass in the corners (spindle axis to the outer contour). The cross sections and the height of the teeth on the outermost wheel of the planetary gear (or gearbox) are at the same time a stop for a securing disk that serves as an axial securing means and forms the boundary, toward the motor, of the planet wheels of the first stage. The securing disk has two wings that protrude past its circumference; they snap in bayonet mount fashion into two corresponding indentations in the gearbox and can be secured against axial loosening by being rotated in an adjoining annular groove. At the same time, this provides security while the tool is being carried for the gear that can be supplied separately. In the built-in state, the disk is retained by its wings between the motor and the gearbox. A securing disk with protruding, angled wings can also be used; these wings can be secured in the indentations by being pressed into them.

The planetary gear is provided with an autolock system, that is, with a self-locking power takeoff spindle upon rotation of that spindle upon external engagement by force. Its gearbox has axial extensions at the top and bottom toward the motor, with an annular groove and an annular bead. Annular beads of the half shells of the motor housing engage the inside of this annular groove and have a corresponding counterprofile. The gearbox is thus received and axially fixed without such further components as screws, rivets, or overlocking tongues. Laterally, where the gear has recesses between these extensions, axial counterpart extensions of the half shells protrude inward. This arrangement serves to secure the gearbox against relative rotation with respect to the motor housing—without using separate components. The axial extensions are asymmetrical, to assure unambiguous assembly.

The gearbox, the circuit board with the battery, motor, LEDs, and electrical elements, as well as the switch pressing means with a contact plate and springs and the transparent plastic part, are all placed in a first half shell and closed with the second half shell and then closed with only four identical screws and are thus completely installed and result in an inexpensive embodiment.

The compact structure makes it possible to hold the device in one hand at the front, at the gearbox or the adjoining motor housing, in such a way that a screw can be held against the bit with the index finger, while at the same time the large-area ON/OFF button can be conveniently operated using the other fingers, while the free hand can hold the workpiece.

The large-area rubber covering with the bumpy surface over the entire grip region lets the cordless screwdriver rest with an especially secure grip and in a fitted way in the user's hand.

BRIEF DESCRIPTION OF THE DRAWINGS

The invention is described in further detail in terms of an exemplary embodiment in conjunction with the drawings.

DETAILED DESCRIPTION OF THE EXEMPLARY EMBODIMENT

Figure 1:
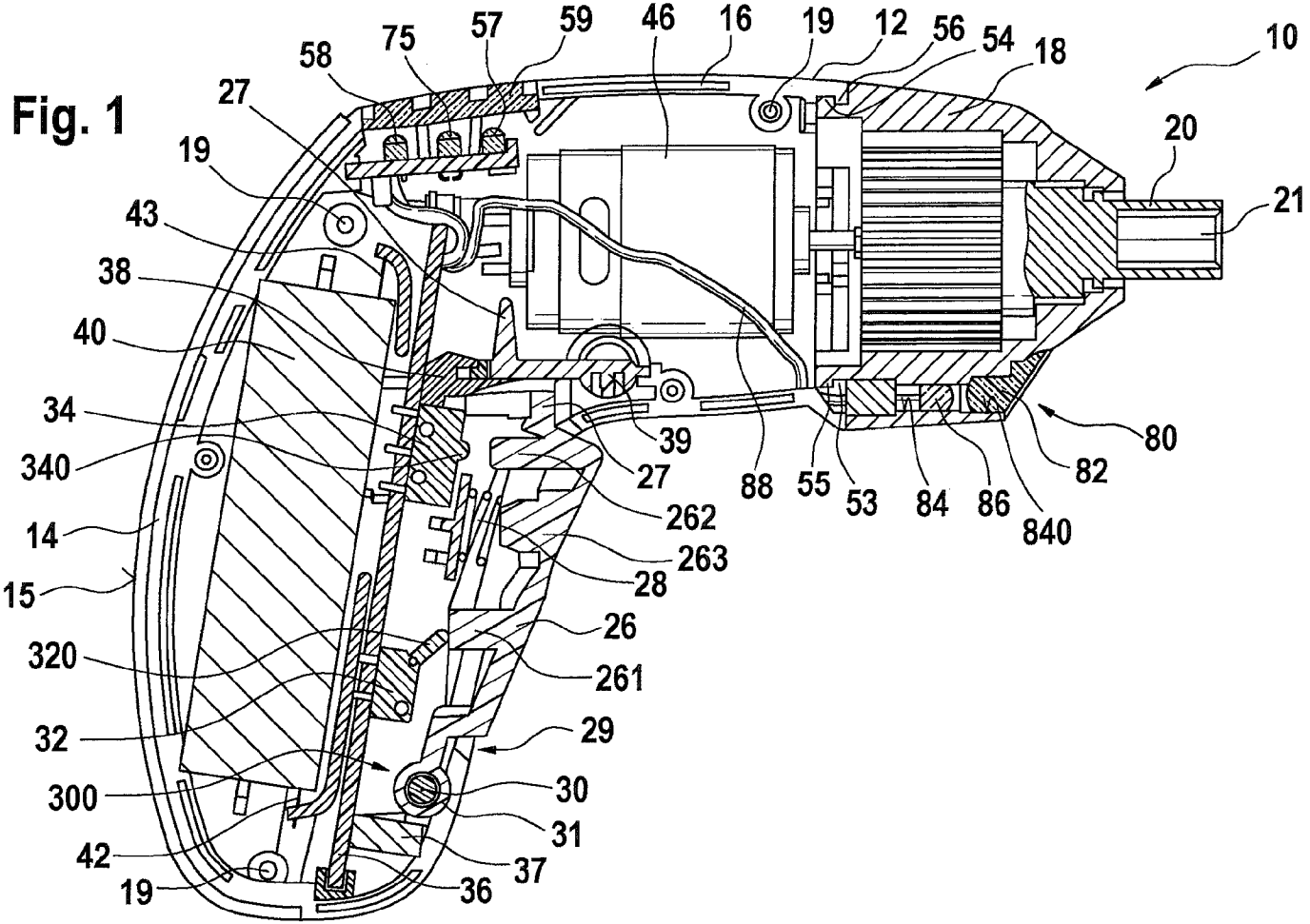
FIG. 1 shows a side view of the partly open cordless screwdriver.
Figure 4:
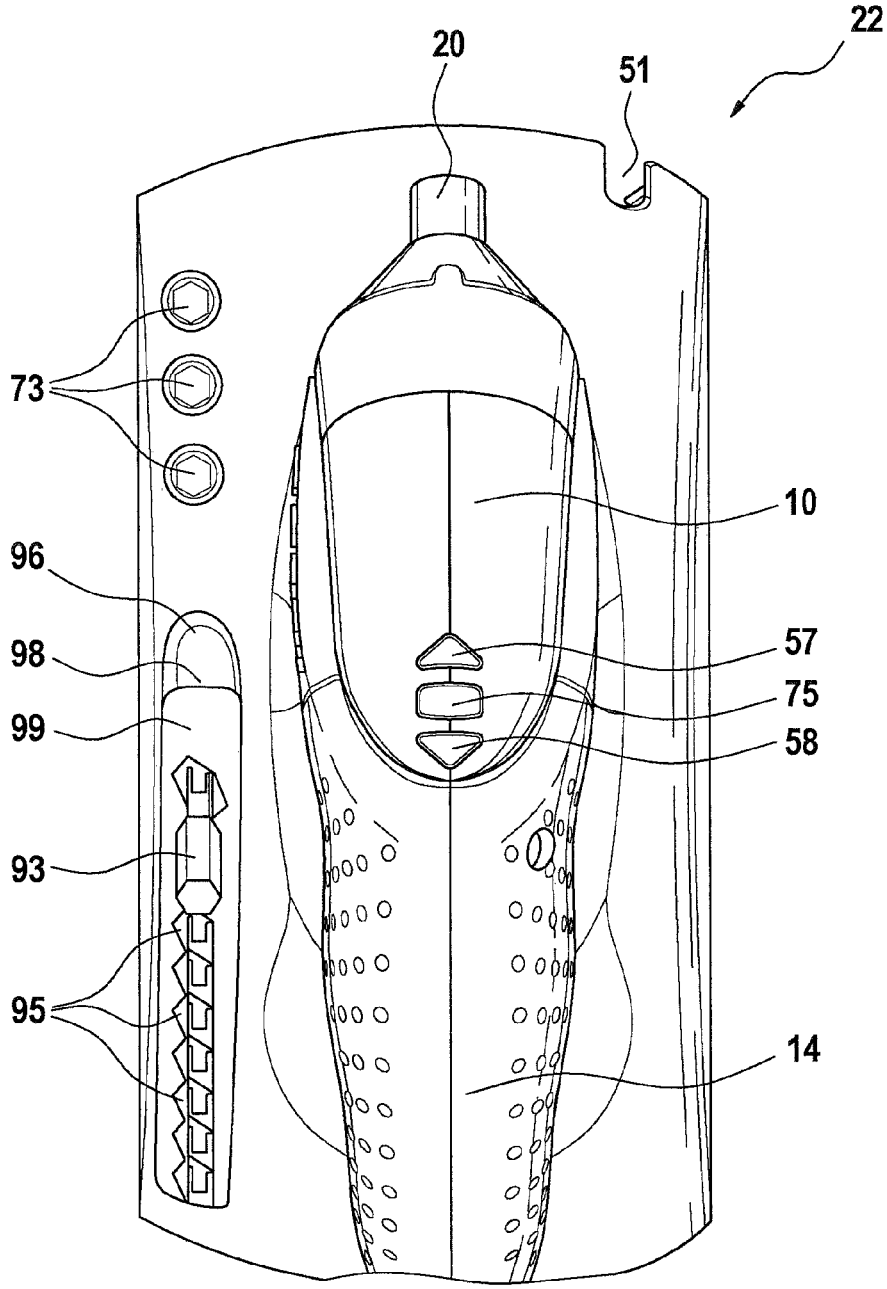
FIG. 4 is a plan view from the top on the cordless screwdriver positioned in the charging shell.

FIG. 1 shows a pistol-shaped cordless screwdriver 10 with a motor housing 12, aligned with the screwing direction, and a pistol grip 14 angled from it. The motor housing 12 with the pistol grip 14 is formed from two half shells 16, 17, which can be put together, braced tightly against one another, in a center plane 15 (FIG. 4). To that end, four screws reach through bores in one half shell 17 into four screw domes 19 of the other half shell 16 and firmly hold the two against one another; in FIG. 1, the upper or right-hand half shell 17 has been removed to make it possible to see into the interior of the housing 12, received only by the left-hand half shell 16.

A toggle switch 26 is located on the pistol grip 14, extending over a large area of its front face end; because of its great length, this toggle switch permits convenient switching on and off of the cordless screwdriver 10, even when it is held in difficult positions in the user's hand.

For inserting the toggle switch 26 into the motor housing 12, a corresponding opening 29, half of which is located in each of the two half shells 16, 17, is provided; in shaftlike fashion, it closely grasps and guides the toggle switch 26. The toggle switch 26 protruding to the outside from the insertion opening 29 in the housing 12 is designed as a pivot lever that is accessible from outside for the user's hand, and in the interior of the pistol grip 14 it communicates with two separate switches 32, 34. It is supported pivotably to a limited extent about a pivot shaft 30 in the shaft holder 31, and on the opposite end of the pivot shaft 30 it has a stop tongue 27, which engages the insertion opening 29 for the toggle switch 26 in the interior of the pistol grip 14 in a securing way, so that it is secured against unintentionally emerging from the housing 12 past its OFF position and being lost.

The toggle switch 26, with a centering and guide spur 263 on its back side, engages a compression spring 28 which is braced next to t in the interior of the pistol grip 14, so that the toggle switch 26, on being released from its ON position, automatically returns to its OFF position, in which the motor motion is stopped and all the previously activated secondary switch functions, such as the work light 80, the direction of rotation displays 57, 58 or the charge status display 75, are switched off. The actuation stroke is approximately 4 mm long in the middle of the toggle switch 26 and hence is short and user-friendly.

The two switches 32, 34 are located, at a mutual longitudinal spacing of approximately 20 mm and parallel to the center plane 15, on an elongated circuit board 36 extending in the interior of the pistol grip 14, closely adjacent to the back side of the toggle switch 26; their respective toggle switches 320, 340 can be tripped in succession by switching cams 261, 262 of the toggle switch 26 when that button is depressed and pivoted about the pivot shaft 30. Upon depression of that button, the switch cam 261 first comes into contact with the toggle switch 320 of the first (primary) switch 32 and thus closes the power circuits that were previously kept uninterrupted by the switch 32, so that one or more secondary functions, such as the lighting 80, are thus switched on. Upon further depression, the upper switch cam 262 comes into contact with the short toggle switch 340 of the second switch 34 and thus closes the primary power circuit, still kept uninterrupted previously by the switch 34, to supply power to the motor 46, so that the motor rotates with the lighting 80 and other added electrical secondary functions switched on.

By means of an electronic circuit not identified by reference numeral in the interior of the housing 12, it is assured that when the motor 46 is in operation, the charge status display 75 in the upper region of the housing 12 cannot be switched on and does not light up, while the direction of rotation display 57, 58 is displayed as a secondary function.

The circuit board 36, in its lower region, also has two symmetrically located charging contact tongues 37, which emerge at a right angle from the flat side of the circuit board 36 and on each end form a large bearing face bent outward at an angle. To that end, each half shell 16, 17 has a respective through opening, symmetrically to the center plane 15 in the lower end of the pistol grip 14, for each of the charging contact tongues 37. The latter are embedded in "countersunk" fashion at each passage point, each in a respective indentation inside the contour of the pistol grip, and are accessible to outward-protruding charging contacts 23 of the charging shell 22, which in the charging state when resting on the charging shell 22 fit over it and are braced on it in a securely contacted way because of their resilient arrangement.

The circuit board 36 also, approximately in the middle, has interference resistors and capacitors, not identified by reference numeral, which are flat and near the surface, and in the upper region, it has a sliding switch 38 and on the upper end, each under a respective arrowhead-shaped aperture or window 59, it has two light-emitting diodes 57, 58, aligned longitudinally, for visually displaying the direction of rotation, and centrally between them it has a rectangular window, beneath which is a further LED 75, which serves as a charge status display and by blinking more or less rapidly indicates to the cordless screwdriver user whether the battery is sufficiently charged or is charged only slightly. The window covering the LED 75 has a pictogram, known from automotive engineering, of a gas pump with a hose, which is a reminder to "fill up" and unmistakably tells the user of the cordless screwdriver 10 that the battery 40 needs to be charged.

The circuit board 36 is located with its long side parallel to the pistol grip 14 and thus with its short side transverse to the center plane 15. It is clamped without play in groovelike recesses, not identified by reference numeral, in the two half shells 16, 17 in such a way that it is braced from the inside against the half shells 16, 17 and thereby forms a reinforcement rib in the pistol grip 14. Parallel to the circuit board 36, a lithium-ion cell, with its familiar advantages, is placed as a battery 40 in the pistol grip 14; in the assembled state, this battery is embraced in pincerlike fashion and positionally secured by the two half shells 16, 17 and is thus integrated into the strength structure of the housing 12. At the top and bottom, the battery 40 has a respective contact plate 42, 43, acting as a soldered lug, which is wired to the circuit board 36.

Just above the toggle switch 26 and within reach of the user's fingers, a slide button 39 (FIG. 2) is located in the nip between the angled pistol grip 14 and the motor housing 12, located in such a way that it can be displaced back and forth transversely to the center plane 15 of the motor housing 12, guided through lateral openings, not identified by reference numeral, in the half shells 16, 17. The slide button 39, with a fork-shaped extension 390 not further shown, grasps a slide device 41 (FIG. 2) of the boxlike sliding switch 38 fixed in the upper region of the circuit board 36. The slide device 41 over which the extension 390 fits can be adjusted by means of the slide button 39 into the outermost left- and right-hand side positions and—for carrying the cordless screwdriver 40, for instance in the pants pocket of the user—into a middle position. In the middle position, the extension 390 of the slide button 39 locks the toggle switch 26 to such an extent that the toggle switch can be actuated only for switching on the work light 80 by means of the switch 32, but the switch 34 for switching on the power supply of the motor 46 cannot be actuated.

A direct current motor 46 in the front region of the motor housing 12 is grasped in pincerlike fashion by the half shells 16, 17 after they have been assembled and is kept in aligned orientation without play in its work position parallel to the gearbox 18 placed in the motor housing 12. The motor 46 has one rear and one front steplike motor collar 48, 49 (FIG. 3), from which the rear and front ends of the motor shaft 45, respectively, emerge. Via its front and rear motor collars 48, 49, the motor 46 is supported, braced in centered fashion, in corresponding bearing-blocklike ribs of the half shells 16, 17. The front end 47 of the motor shaft 45 is provided with a flattened face or dihedron, particularly being creatively shaped, and thus in the installed position engages a corresponding flattened recess of an inlet pinion 66 of the gear 65, designed as a planetary gear, that is located in the gearbox 18. A force-locking coupling with coarse dimensional tolerance and ease of assembly is thus created; the motor 46 with the gear 65 or gearbox 18 can easily be put together placed, in put-together form, in one of the half shells 16, 17 for further assembly.

On the face end, in pincerlike and form-locking fashion, the two half shells 16, 17 embrace a gearbox 18, installed as a separate cylindrical structural group and firmly hold it without play. The gearbox, in two axial, tonguelike, partly cylindrical extensions 60 (FIG. 3) extending toward the motor housing 12, has an annular housing groove 54, which is defined by an annular bead 55. The annular bead 55 engages a fitting counterpart annular groove 56 on the inside of the face end of the half shells 16, 17 of the motor housing 12, and fitting counterpart annular beads 43 of the half shells 16, 17 fit in form-locking fashion into the annular housing groove 54 in the gearbox 18.

Counterpart extensions 61 angled transversely to the longitudinal direction of the motor housing 12 engage the two asymmetrical recesses between the two extensions 60 of the gearbox 18 without play and in a way that is secure against incorrect installation; at the same time, in bearing-blocklike fashion they brace the motor collar 58 of the motor 46 in a centering fashion, so that the collar is likewise integrated into the strength structure of the motor housing 12. Separate fastening elements such as screws or the like are unnecessary. This makes assembly easier, with a reduced number of individual parts.

At the top rear, the motor housing 12 has the transparent window 59 placed in it, which extends longitudinally in the parting plane 15 and through three openings in the half shells 16, 17 makes it possible to see through to the green LED, in the form of an arrow pointing forward, and to the red LED 57, 58 in the form of an arrow pointing to the rear, each associated with one direction of rotation of the motor shaft 45 (FIG. 4) and lighting up with it. The third LED 75 is disposed between them; it is designed as a double LED and functions as both a charge display and a charge status display. When the switch 34 is switched on, or when the motor 46 is running, this LED goes out automatically. If the cordless screwdriver 10 is in the charging mode, the charge display lights up red, even if the toggle switch 26 is in its OFF position. If the battery 40 is partly discharged, the green charge status display, for instance by blinking more or less rapidly, provides information as to whether there is a greater or lesser "energy supply" in the battery 40 when the switch 32 is switched on.

A power takeoff spindle 20, which is designed on its face end as a hexagonal socket 21 for receiving standard bits that fit it, protrudes at the front from the gearbox 18, which tapers to a rounded cone at the front. The hexagonal socket 21 is provided with means that firmly hold the inserted screw driving bit or drill bit, so that a certain resistance must be overcome by hand to remove them axially.

A work light 80 has a scattering disk 82 and an LED 86, which are seated together in a bore 84 approximately perpendicular below the power takeoff spindle 20. The bore 84 extends parallel to the power takeoff spindle through the gearbox 18. In the region of its front opening 840, located to the right in the viewing direction, the bore 84 is widened in stepped fashion and there receives the scattering disk 82 in captive fashion. The LED 86 is connected to the battery 40 or the first switch 32 via an electric cord 88 extending along the inner wall of the motor housing 12 into the bore 84 and can be switched on—as already explained—by actuation of the switch 32.

The scattering disk 82 is designed as an optical lens, especially a Fresnel lens, and is located such that the light emitted by the LED 86 is aimed at an angle upward and into the middle in the near vicinity in front of the power takeoff spindle 20 and focused in front of the screwdriver bit or drill bit received by the hexagonal socket 21, onto a workpiece to be potentially machined.

Figure 2:
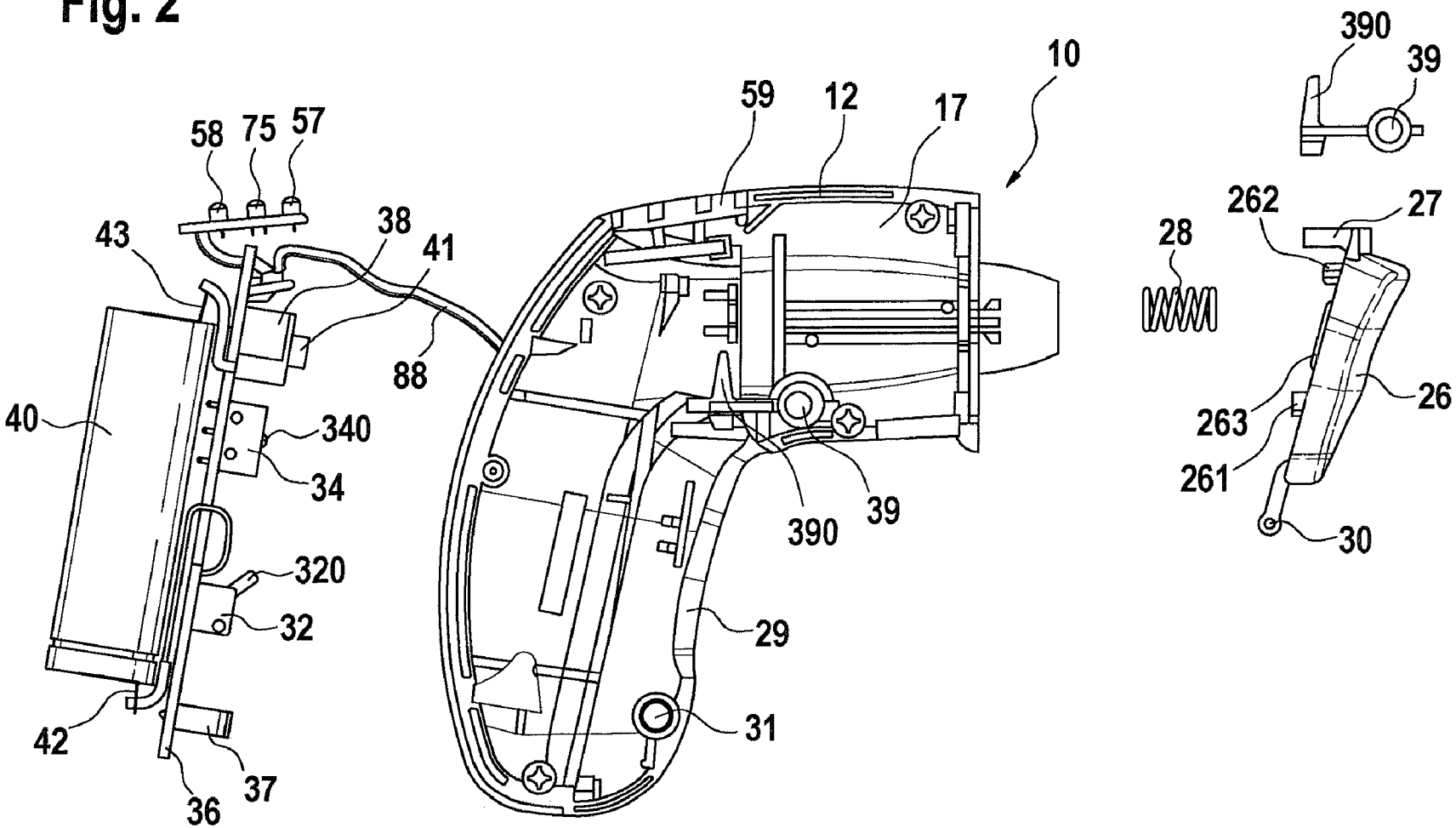
FIG. 2 is an exploded fragmentary view of the cordless screwdriver.

FIG. 2 shows an exploded view of the left-hand half shell 17 of the motor housing 12, with the window 59, located in the top rear region, for the direction of rotation display 57, 58 and the charge status display 75.

To the left in the viewing direction, next to the half shell 17, is the circuit board 36, with the soldered-on battery 40 and the switches 32, 34, 38 as well as the LEDs 58, 57, which are connected electrically with the sliding switch 38 and with the electric cord 88 for the work light 80. The LED 75 is connected to a circuit, not identified by reference numeral, that serves to monitor its charge state and triggers the LED 75 accordingly with a higher or lower blinking frequency. The slide button 39, which is displaceable rectilinearly, transversely to the longitudinal axis of the cordless screwdriver 10, for adjusting the direction of rotation of the motor 46 is seated above the insertion opening 29 for the toggle switch 26. The slide button 39 is shown again as a detail at the top right in the viewing direction; the forklike extension 390 can be seen for engaging the switch device 41 of the sliding switch 38 from behind.

To the right in the viewing direction the toggle switch 26 is shown as a detail; its pivot shaft 30 for insertion into the shaft holder 31 in the half shell 17; the cams 261, 262 for actuating the switches 32, 34; and the spur 263 for receiving the compression spring 28 are visible.

On the side diametrically opposite the pivot shaft 30, the toggle switch 26 has a stop tongue 27, which on the one hand prevents the toggle switch 26 from coming loose out of the insertion opening 29 on the other, when the toggle switch 26 is depressed, locks the slide button 39 in its position that has just been selected, or on the other, when the slide button 39 is in a middle position, prevents the toggle switch from being depressed, or in other words locks it.

Figure 3:
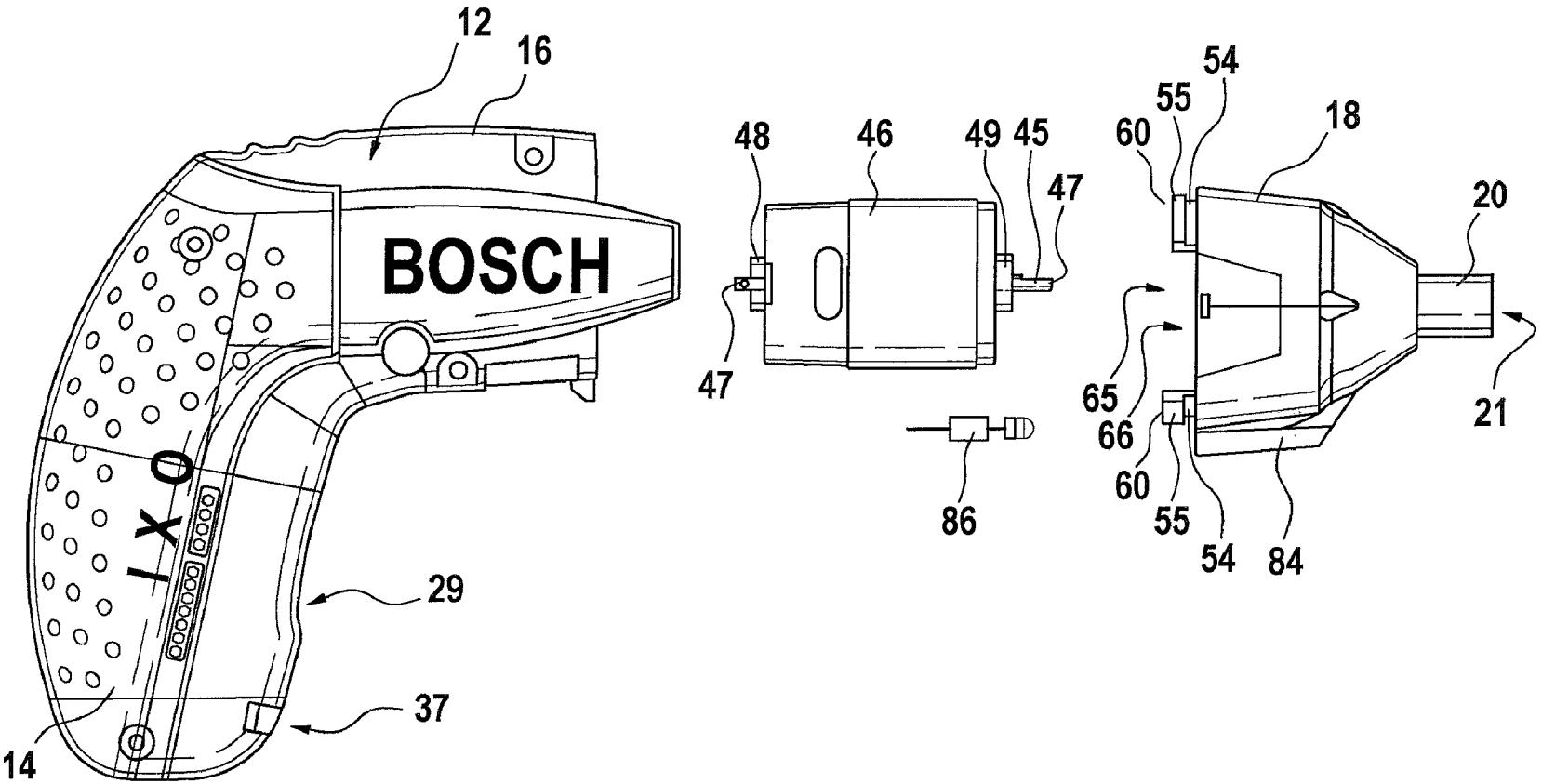
FIG. 3 is a further exploded fragmentary view of the primary structural groups of the cordless screwdriver.

FIG. 3 shows a further exploded view of the cordless screwdriver 10, looking toward the outside of the right-hand half shell 16 of the motor housing 12 and the gearbox 18. Besides the details explained above, only the motor 46 with the rear and front motor collars 48, 49 and the motor shaft 47 with the flattened end 45 will now be mentioned. The end 45 of the motor shaft 47 is intended for insertion into a central slot, not shown, in the input pinion 66 and for slaving it rotationally and thus driving a gear 65 located in the gearbox 18. The gearbox 18 clearly shows the axial extensions 60, oriented toward the motor housing 12, with the annular beads 55 and the annular grooves 54, which can be grasped in form-locking and pincerlike fashion by means of suitable contrary geometries of the ends toward them of the half shells 16, 17 of the motor housing and positionally fixed. The bore 84, located below the power takeoff spindle 20, for receiving the LED 86 can also be seen, as can the LED 86 itself, as a detail of the work light 80.

FIG. 4 shows the plan view from the top on the charging shell 22 with the cordless screwdriver 10 placed on it ready for charging; beyond what has been shown above, a removable bit holder 99 can be seen, which can be held laterally next to the cordless screwdriver 10 by form- and force-locking. This bit holder has machined insertion openings 95 for firmly holding screwdriver bits 93 captive and can be inserted into the charging shell 22, flush with it, in a groove 98 and removed easily from it by using the fingers to reach from below into the extension 96 of the groove 98. It can easily be carried along together with the cordless screwdriver 10 by the user—for instance in his pants pocket.

To the front in an axial extension, the charging shell 22 has three fixed-location insertion openings 73, in which additional screwdriver bits or the like can be carried along, secured being lost.

The plan view on the cordless screwdriver 10 especially clearly shows the LEDs 57, 58 for the direction of rotation display and the charge status display 75 on its top side, along with the center plane 15.

Figure 5:
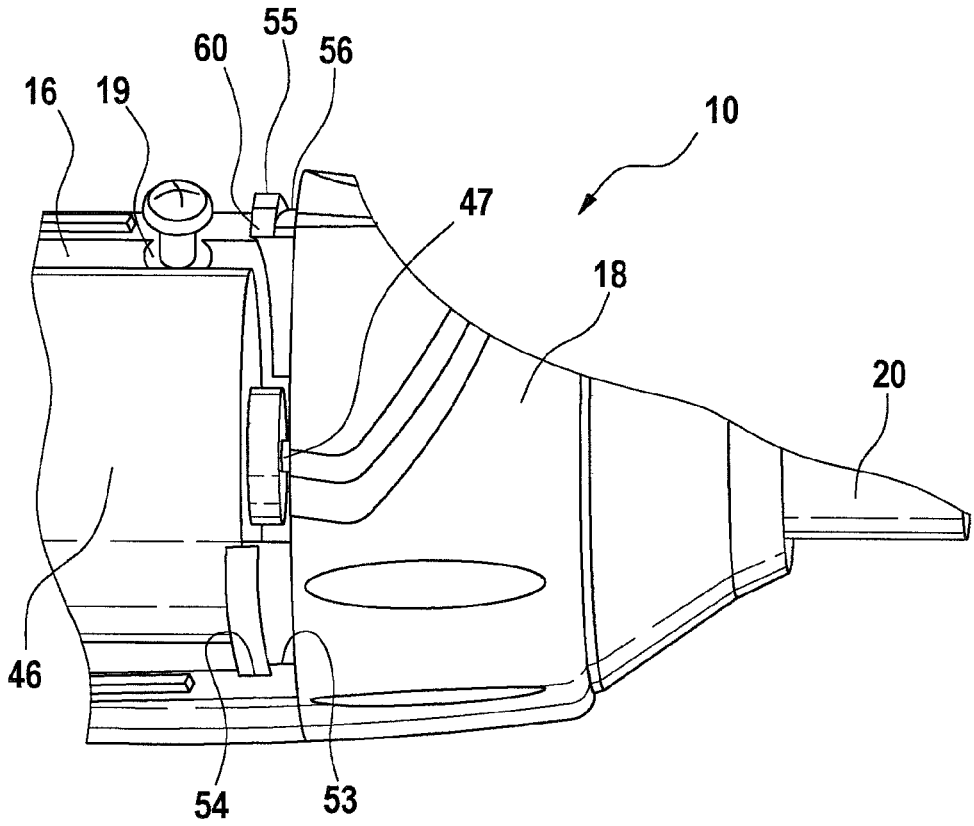
FIG. 5 is an enlarged detail of the gearbox from FIG. 1.

FIG. 5 is a detail showing the front region of the cordless screwdriver 10 with the lower half shell 16, looking toward the motor 46 and the gearbox 18, which are joined together, fitting one inside the other in form-locking fashion.

Figure 6:
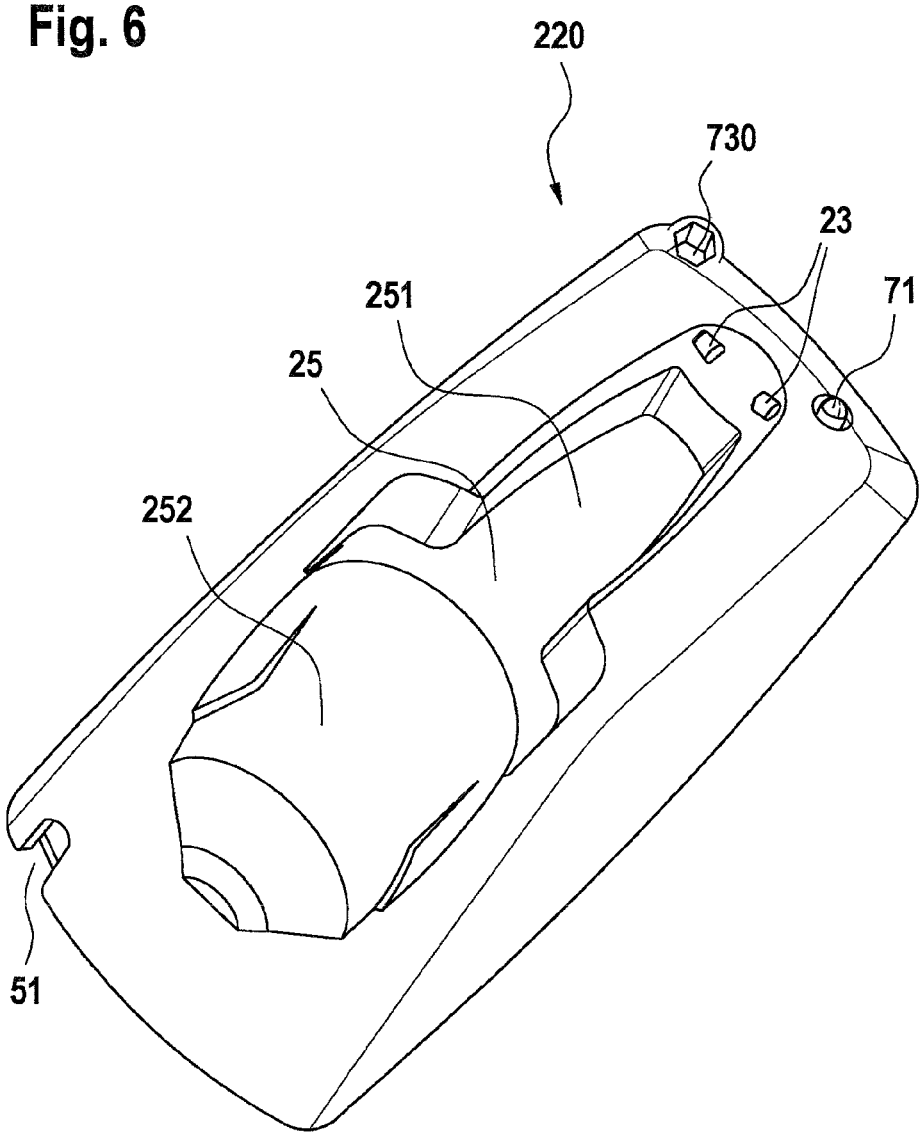
FIG. 6 is a three-dimensional view of the charging shell as a detail from above.

FIG. 6 shows a plan view from above on a further embodiment of the charging shell 220 with a molded bed 25, which is subdivided into a pistol grip bed 251 and a gearbox bed 252, into which beds the cordless screwdriver 10 can be placed flush and virtually without play, unambiguously and in a foolproof way, so that it rests securely, and its charging contact tongues 37 (FIGS. 1, 2, 3) maintain secure contact with the charging contacts 23 of the charging shell 220.

The outer contour of the charging shell 220 has beveled sides and is thus made to conform to the pistol-shaped inner and outer contour of the cordless screwdriver 10. The charging contacts 23 protrude out of the contour of the charging shell 23 in the region of the pistol grip bed 251, into which the cordless screwdriver 10 snaps with its pistol grip 14 and is thus braced by its own weight with its charging contact tongues 37 on the resilient charging contacts 23 of the charging shell 22. Solely by placing the cordless screwdriver 10 on the charging shell 220, the charging state is immediately established with an audible click.

The charging shell 220 has a recess 51 at the left front, in the viewing direction, for an electric cord, not further shown, to emerge from; in the rear region, associated with the pistol grip 14 of the cordless screwdriver 10, this recess has a charge monitoring light 71 and a perpendicular insertion opening 730 for captive retention of a standard screwdriver or drill bit with a hexagonal shaft.

Figures 7, 8:
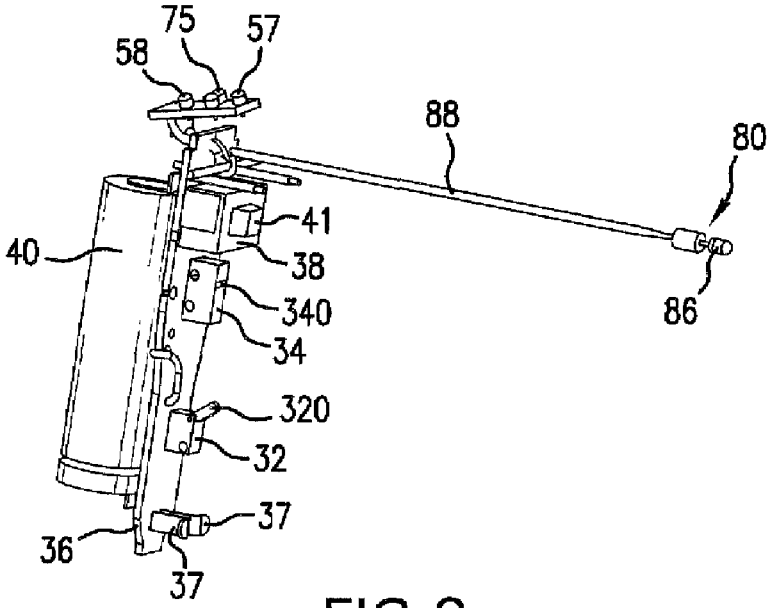
FIG. 7 shows a matrix with the switching states of the primary and secondary functions of the cordless screwdriver.
FIG. 8 is a three-dimensional view of the circuit board with the battery, switches and LEDs.

The matrix shown in FIG. 7 shows the switching states of the circuits for the primary and secondary functions of the cordless screwdriver 10 and provides a systematic overview and information as to which functions are running, based on the actuation stroke of the toggle switch 26—see the first column; for instance, the direction of rotation is not already shown when the toggle switch 26 is depressed halfway but only once it is fully depressed—in contrast to the work light 80, which already lights up as soon as the toggle switch 26 has been halfway (½) actuated.

It can be seen from this that the LED 75 for displaying the charge lights up in green when the cordless screwdriver 49 rests on the charging shell 22 and when charging current is flowing and goes out when the toggle switch 26 is depressed.

The three-dimensional view shown in FIG. 8 of the circuit board 36 with the battery 40; the switches 32, 34, 38; the LEDS 57, 58, 75; and the charging contact tongues 37 again clearly illustrates the explanations made of FIG. 1.

The LED 75 may be embodied as a double LED or as an assembly of two individual LEDs side by side. The LED 75 indicates the charge status—in red—only whenever the battery 40 has been discharged to less than ⅓ of its total charging capacity and the toggle switch 26 closes the switch 32. If the toggle switch 26 is depressed further—for activation of the switch 34—the red warning light of the LED 75 goes out. The warning display can also be supplemented with a blinking device, controlled by charging current, so that upon even greater discharging of the battery 40, especially fast blinking of the red display, and with a less severe discharge slower blinking, gradually inform the user of the charge status of the battery 40.

The green LED 75 lights up only in the charging mode of the cordless screwdriver 40, or in other words when the cordless screwdriver is positioned in the charging shell 22 and charging current is flowing, and it goes out if no charging current is flowing in the cordless screwdriver 40.

Figure 9:
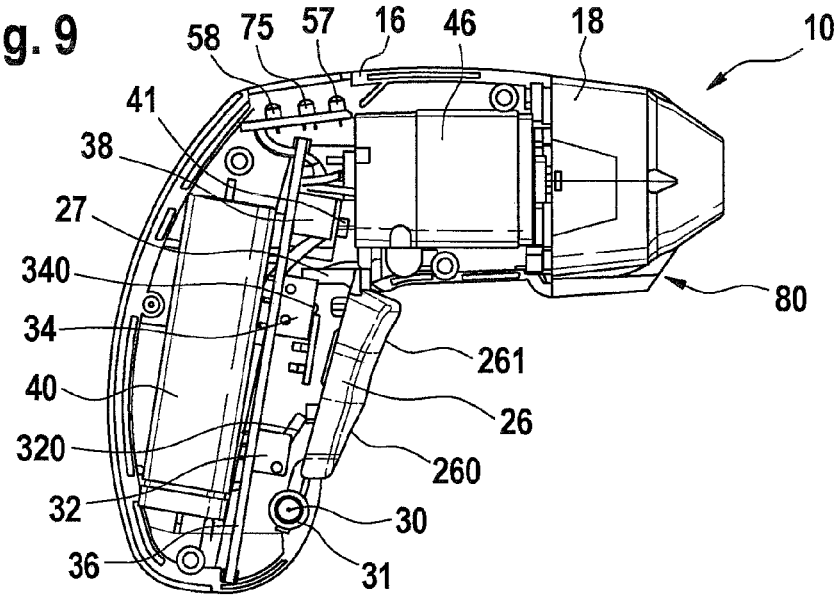
FIG. 9 is a further side view of the partly open cordless screwdriver.

A further side view of the cordless screwdriver 10 shown in FIG. 9, with the half shell 17 taken off, again clearly shows the explanations made of FIG. 1, and the design of the toggle switch 26 for sequential actuation of the two switches 32, 34 should be especially emphasized.

Figure 10:
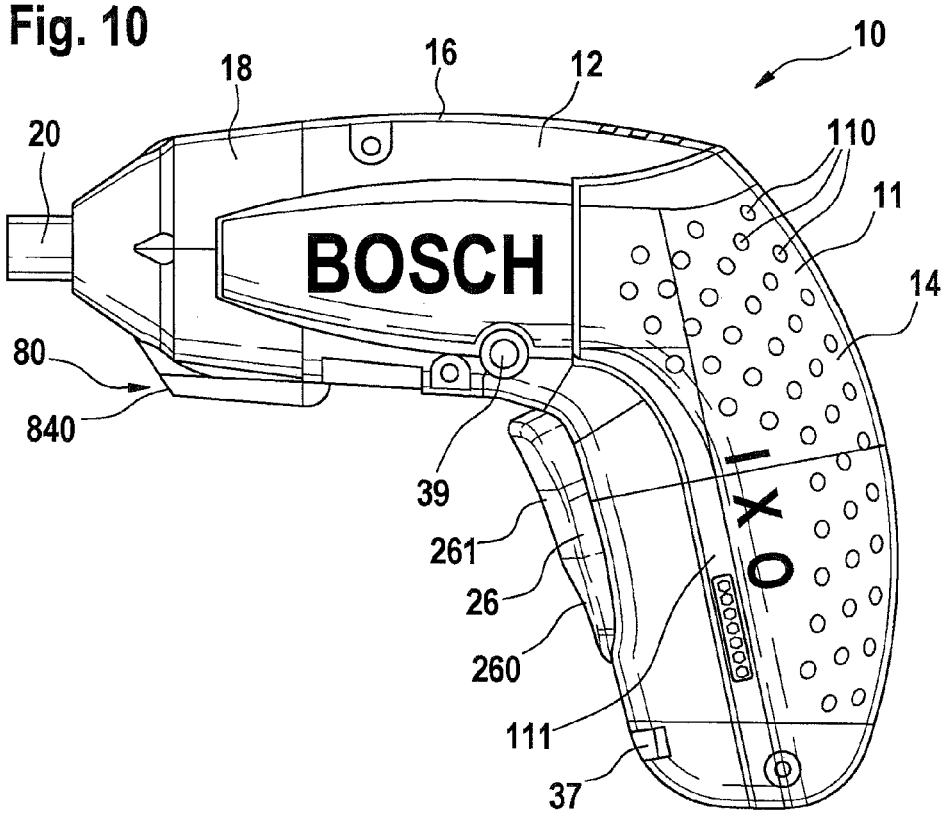
FIG. 10 shows the cordless screwdriver in a side view from the left.

The left-hand side view of the cordless screwdriver 10 shown in FIG. 10, looking toward the outside of the left-hand half shell 16, shows the details of FIG. 1 clearly, in particular the outer contour of the toggle switch 26, provided on the face end with two concave indentations 260, 261; one of the charging contact tongues 37; the slide button 39 designed in the form of a cylindrical pin; and at the bottom front of the gearbox 18, the contour of the opening 840 of the bore 84 of the work light 80. A rubber covering 11 with a bumpy structure 110 can also be seen in the lateral and rear region of the pistol grip 14, with a lateral bead 111.

The invention claimed is:

1. A cordless screwdriver, having a housing (12, 18) with a pistol grip (14) with a toggle switch (26) and a rechargeable battery (40) inserted into said housing fixedly and with charging contact tongues (37) associated with the rechargeable battery (40), wherein by means of the toggle switch (26), extending in elongated fashion over an interior of the pistol grip (14) and pivotably supported, a plurality of power circuits of the cordless screwdriver (10) are interruptable and closable over an actuation stroke of the toggle switch successively, simultaneously, independently of one another.

2. The cordless screwdriver as recited in claim 1, wherein the toggle switch (26) has various actuation positions, attainable in succession over its actuation stroke in separate actuation positions, associated with two electrical switches (32, 34).

3. The cordless screwdriver as recited in claim 2, wherein the electrical switches (32, 34), upon release of the toggle switch (26), interrupt the power circuits associated with them.

4. The cordless screwdriver as recited in claim 1, wherein one electrical switch (32) serves as a main switch for a plurality of power circuits of the cordless screwdriver (10) and when the toggle switch (26) is depressed undoes the interruption of the power circuits; and wherein the other electrical switch (34) forms a second interruption of a motor power circuit, which is closed by further depression of the toggle switch (26).

5. The cordless screwdriver as recited in claim 1, wherein one switch (32) serves as an interrupter for a work light (80).

6. The cordless screwdriver as recited in claim 1, wherein the toggle switch (26) is braced in prestressed fashion on the housing by means of a spiral spring (28) counter to an actuation direction and is pivotably supported about a pivot shaft (30, 31).

7. The cordless screwdriver as recited in claim 1, wherein only a single, elongated, slender lithium-ion (Li-ion) cell is located as a rechargeable battery (40) in the pistol grip (14).

8. The cordless screwdriver as recited in claim 1, wherein for switchover from clockwise to counterclockwise operation, a sliding switch (38) is located on a circuit board (36) and is actuated via a slide button (39) that is longitudinally displaceable.

9. The cordless screwdriver as recited in claim 8, wherein when the toggle switch (26) is pressed, the sliding switch (38) is blocked; and that the toggle switch (26) is blocked whenever the slide button (39) is in a middle position.

10. The cordless screwdriver as recited in claim 1, wherein one large-area rubber covering (11), protruding laterally in toroidal fashion, with a bumpy structure (110) is located on each half shell (16, 17) in a region of the pistol grip (14).

* * * * *